United States Patent [19]

Boehme et al.

[11] 4,197,062

[45] Apr. 8, 1980

[54] APPARATUS FOR THE MANUFACTURE OF FIBRILS

[75] Inventors: Robert E. Boehme; Clarence R. Murphy, both of Houston, Tex.

[73] Assignee: Gulf Oil Corporation, Pittsburgh, Pa.

[21] Appl. No.: 924,124

[22] Filed: Jul. 13, 1978

Related U.S. Application Data

[62] Division of Ser. No. 812,031, Jul. 1, 1977, Pat. No. 4,125,584.

[51] Int. Cl.[2] ..... D01D 5/00

[52] U.S. Cl. ..... 425/6; 425/8

[58] Field of Search ..... 264/142; 241/27, 154, 241/142, 5, 185, 138, 86; 425/67, 68

[56] References Cited

U.S. PATENT DOCUMENTS

| | | | |
|---|---|---|---|
| 2,451,448 | 10/1948 | Raffon | 241/27 |
| 2,518,133 | 8/1950 | Fox | 241/27 |
| 2,916,217 | 12/1959 | Yellott | 241/154 |
| 2,937,857 | 5/1960 | Thurman | 241/154 |
| 3,070,835 | 1/1963 | Alsys | 264/142 |
| 3,559,895 | 2/1971 | Fay | 241/5 |
| 3,973,733 | 8/1976 | Switzer | 241/5 |

*Primary Examiner*—Jay H. Woo

*Attorney, Agent, or Firm*—Richard L. Kelly

[57] ABSTRACT

Centrifugal spinning apparatus is provided for the manufacture of fibrils from hot viscous hydrocarbon solutions of olefin polymers having an intrinsic viscosity of at least 3.5. The apparatus consists of an impeller which rotates at high speed in a cylindrical cavity having a discharge port. The impeller has a plurality of blades whose narrow dimensions lie substantially in the plane of the impeller's rotation and whose tips come in close proximity to the inner peripheral surface of the cylindrical cavity. The blades are arranged in at least two substantially-identical sets. Within each set, the blades are offset substantially equidistant from one another, both in the rotational plane of the impeller and in the plane transverse thereto. Two inlet ports are provided in the peripheral surface of the cylindrical cavity to feed liquids to the cylindrical cavity, each of which port is narrow in a plane transverse to the plane of the impeller's rotation and extends over substantially the entire peripheral surface. The inlet ports are positioned near the discharge port of the cylindrical cavity and upstream thereof viewed with respect to the impeller's rotation, so that the bulk of the liquids entering the cavity from the inlet ports are swept away from the discharge port by the impeller's rotation.

5 Claims, 5 Drawing Figures

FIG. 1
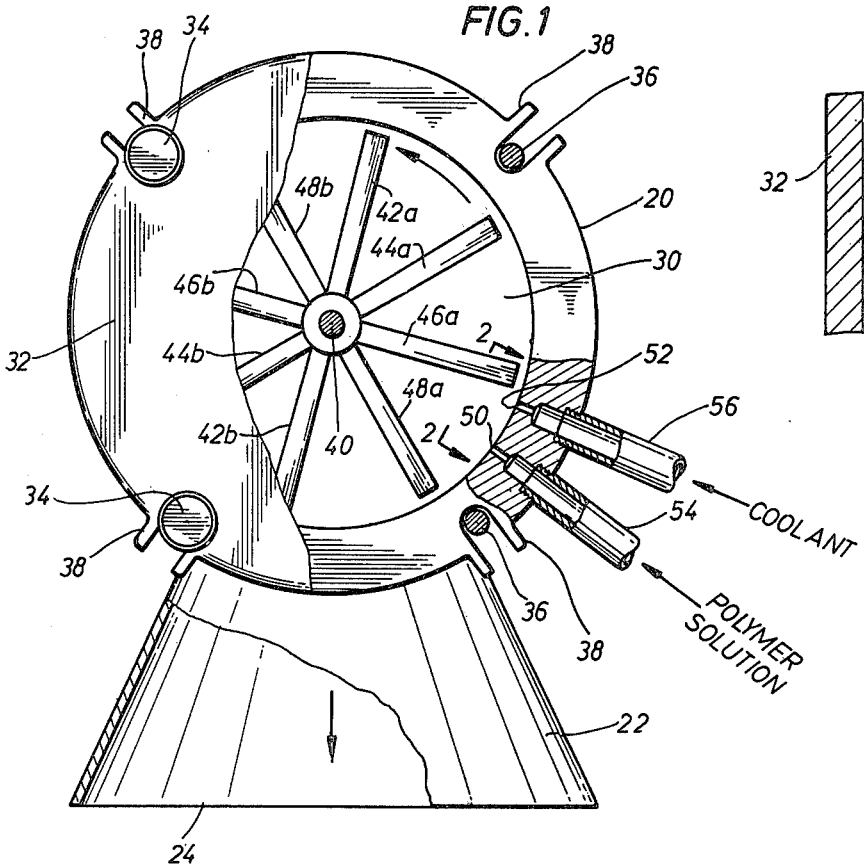
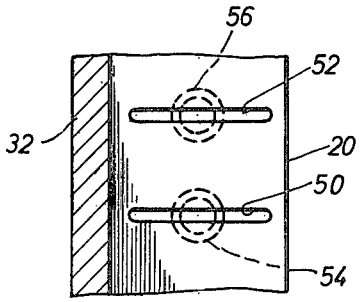
FIG. 2
FIG. 3
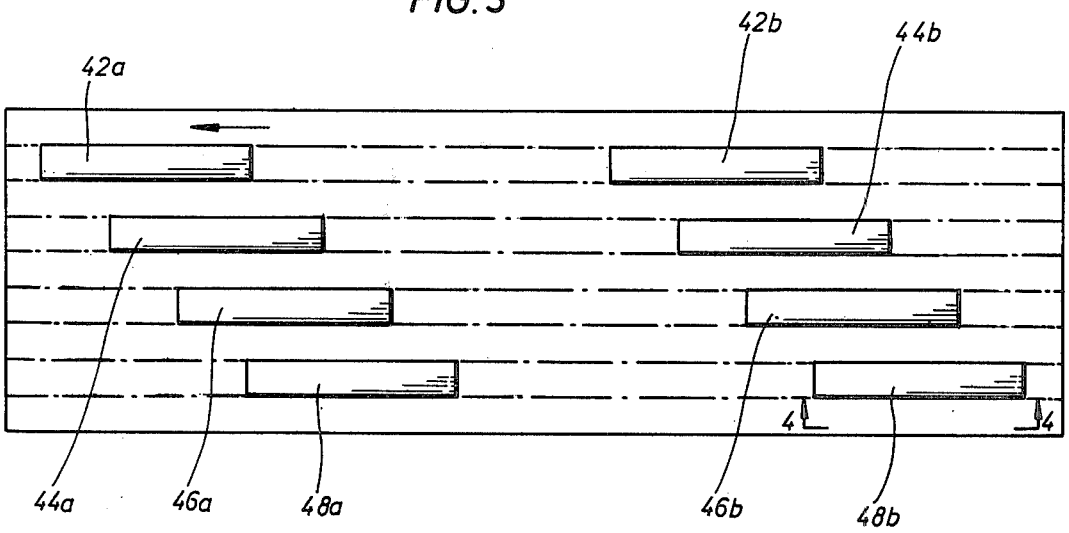

APPARATUS FOR THE MANUFACTURE OF FIBRILS

This is a division of application Ser. No. 812,031 filed July 1, 1977, now U.S. Pat. No. 4,125,584.

BACKGROUND OF THE INVENTION

The Parrish patent U.S. Pat. No. 2,988,782 discloses the manufacture of very fine polymer filaments that can be employed to manufacture water-laid sheets of synthetic paper. These synthetic filaments are of such a small diameter that they behave quite differently from spun filaments and have been characterized in the art as "fibrils" or "fibrids."

The Parrish process for preparing such fibrils involves preparing a solution of a polymer in a suitable solvent and adding the polymer solution to a vigorously-agitated solution of a liquid, which is a nonsolvent for the polymer of interest. As the polymer solution is added to the vigorously-stirred nonsolvent liquid, the droplets of the polymer solution are subjected to shear forces and attenuated while simultaneously being precipitated. Parrish discloses that the precipitation step is carried out in a high intensity mixer such as a Waring blender. While the Parrish process is suitable for making small laboratory quantities of such fibrils, the process is not well suited to make substantial quantities of the fibrils at an acceptable cost.

The Davis, et al, patent U.S. Pat. No. 4,013,751 discloses an alternate process for preparing fibrils by modified methods in which a hot polymer solution is passed through a Hammermill and subsequently cooled as the streams of polymer solution are thrown free of the rotating plate of the Hammermill. While this process provides good quality fibrils, the process is capital intensive and has higher manufacturing costs than is desired.

There is a need in the art for improved apparatus and processes for manufacturing fibrils at a lower cost.

BRIEF DESCRIPTION OF DRAWINGS

FIG. 1 is an end view of one embodiment of centrifugal spinning apparatus of the invention, partially in section, with parts broken away.

FIG. 2 is a view taken through lines 2—2 of FIG. 1.

FIG. 3 is a view of the rotating impeller blades as seen from the inner peripheral surface of the apparatus of FIG. 1 with the peripheral surface extended into a flat plane to show the pattern made by the rotating blades.

SUMMARY OF THE INVENTION

Figure 5:
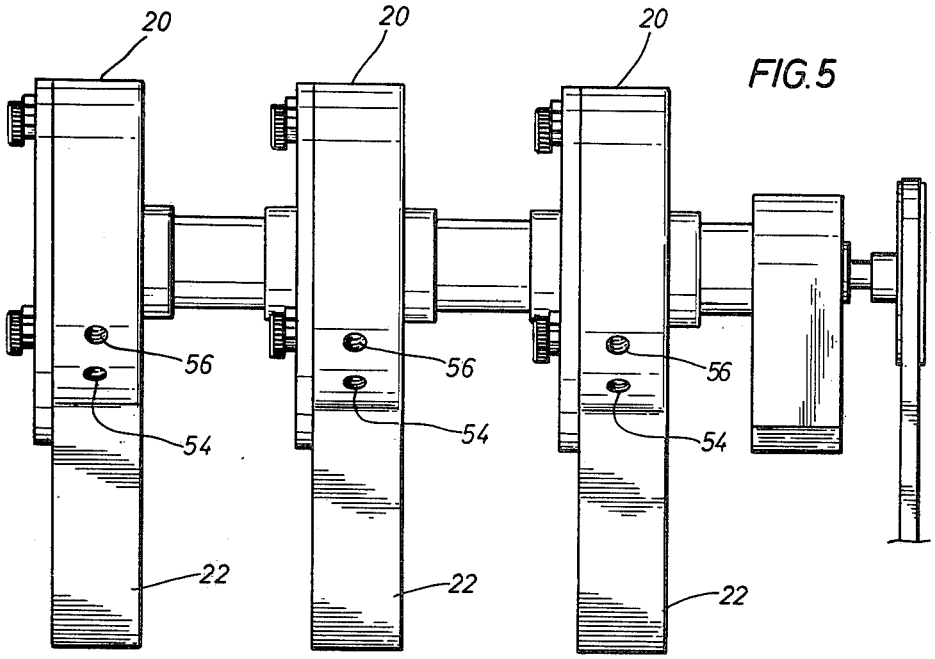
FIG. 5 is a side plan view showing three pieces of the centrifugal spinning apparatus shown in FIG. 1 ganged together and driven by a common shaft.

Novel centrifugal spinning apparatus has been developed for the manufacture of fibrils from hot viscous hydrocarbon solutions of olefin polymers having an inherent viscosity of at least 3.5. The apparatus consists of an impeller which rotates at high speed in a cylindrical cavity having a discharge port. The impeller has a plurality of blades whose narrow dimensions lie substantially in the plane of the impeller's rotation and whose tips come in close proximity to the inner peripheral surface of the cylindrical cavity. The blades are arranged in at least two substantially-identical sets. Within each set, the blades are offset substantially equidistant from one another; both in the rotational plane of the impeller and in the plane transverse thereto. Two inlet ports are provided in the peripheral surface of the cylindrical cavity to feed hot polymer solution and coolant liquid to the cylindrical cavity, each of which port is narrow in a plane transverse to the plane of the impeller's rotation and extends over substantially the entire peripheral surface. The inlet ports are positioned near the discharge port of the cylindrical cavity and upstream thereof viewed with respect to the impeller's rotation, so that the bulk of the liquids entering the cavity from the inlet ports are swept away from the discharge port by the impeller's rotation.

The hot polymer solution fed to the apparatus is broken up into droplets by the rotating impeller blades. Individual droplets impinge upon the surface of the impeller blades and are attenuated into thin streams. In a like manner, the coolant liquid impinges upon the impeller blades and cools the attenuated polymer streams to precipitate the solute polymer in the form of fibrils.

DETAILED DESCRIPTION OF THE INVENTION

Referring to FIGS. 1 and 2, the centrifugal spinning apparatus includes a housing 20 having a cavity 30 machined therein and having a downwardly and outwardly extending lower discharge port 22 which terminates at its lowermost end in an opening 24. The ratio of diameter to depth in cavity 30 preferably is at least 5.0:1.0. Cavity 30 normally is covered and sealed by a removable front plate 32. Front plate 32 is held in position of the front of housing 20 by means of a plurality of nuts 34 secured to the ends of bolts 36 which are pivotally mounted to housing 20 and extend through U-shaped slots 38. An impeller is mounted within cavity 30 on shaft 40 and consists of four blades 42, 44, 46, and 48. The impeller blades are separated from each other by washers not shown and are locked in fixed positions by suitable keys not shown. The two halves of each blade are shown as, respectively, 42*a* and 42*b*, 44*a* and 44*b*, 46*a* and 46*b*, and 48*a* and 48*b*. The blades are offset from each other in fixed positions so that the blades 42*a*, 44*a*, 46*a*, and 48*a* constitute one set of blades, each of which is offset substantially equidistant from each other, both in the rotational plane of the impeller and in the plane transverse thereto. In a like manner, the blades 42*b*, 44*b*, 46*b*, and 48*b* constitute a second substantially-identical set of blades, with these blades also being offset substantially equidistant from each other, both in the rotational plane of the impeller and in the plane transverse thereto. The impeller rotates in the direction of the arrow at high speed so that the tip speed of each of the blades is at least about 200 feet per second and preferably greater than 500 feet per second.

Two inlet ports 50 and 52 of rectangular cross section are provided in the inner peripheral surface of cavity 30, and extend over substantially the entire inner peripheral surface in a plane transverse to the rotational plane of the impeller. Tapped openings in the peripheral surface communicate with inlet ports 50 and 52 and are threaded to receive liquid feed tubes 54 and 56.

In operation of the process, it is customary to drive a plurality of units from a single shaft. FIG. 5 illustrates three units being ganged together for operation off one drive shaft.

While the apparatus illustrated in the drawings represents the preferred embodiment of the invention as presently perceived by the applicants, a number of modifications can be made therein. The apparatus illustrated contains four impeller blades which constitute two separate sets of blades. By increasing the ratio of the cylindrical cavity's depth to its diameter, it is possible to mount a significantly greater number of blades on the shaft. While the illustrated apparatus is mounted so that the impeller blades rotate in the earth's gravitational field, the apparatus can be rotated 90° so that the impeller rotates in a plane perpendicular to the earth's gravitational field. When operated in this mode, the product discharge port is in one side of the apparatus and the centrifugal force of the impeller blades transfers product into the discharge port.

Figure 4:
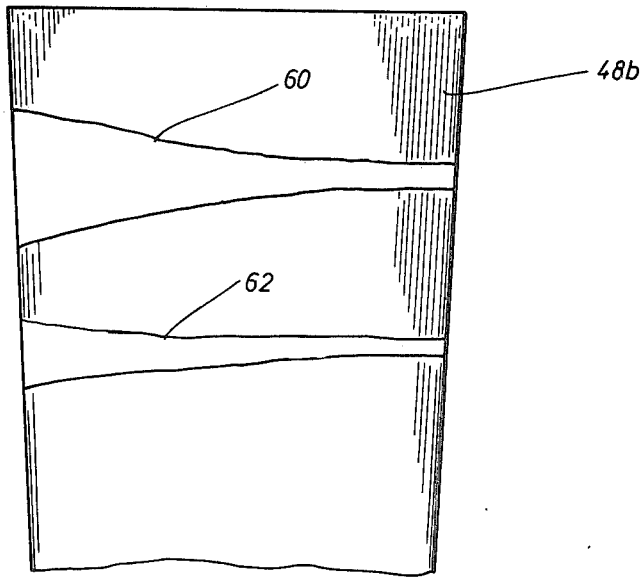
FIG. 4 is a view taken through lines 4—4 of FIG. 3.

In operation the impeller is rotated by an external motor at high speed to provide tip speeds in excess of 200 ft./sec. At these speeds, the two tips of each blade, e.g., 42*a* and 42*b*, 44*a* and 44*b*, etc., function essentially as one continuous knife blade. This action is shown in FIG. 3 in which rotation of the impeller blades is shown in an extended, flattened plane. A polymer solution, consisting of about 4 weight % of a high molecular weight olefin polymer having an intrinsic viscosity of at least 3.5 dissolved in a kerosene-type of hydrocarbon, heated to a temperature of about 190° C., is fed to cavity 30 through inlet port 50. Upon entering cavity 30, the polymer solution impinges upon the impeller blades and is broken up into a multiplicity of droplets which are carried by centrifugal forces around the periphery of cavity 30 until they reach discharge port 22. Virtually all of the droplets of polymer solution will come into contact with the face of an impeller blade. When this occurs, the droplets as indicated by 60 and 62 in FIG. 4 are attenuated by centrifugal force to form thin polymer streams as shown, this action having the effect of orienting the solute polymer molecules in the direction of the applied centrifugal force.

A coolant liquid, preferably water, is fed to cavity 30 through inlet port 52. The coolant liquid impinges upon the impeller blades and is carried to discharge port 22 by centrifugal forces in the manner previously described. Upon contacting the impeller blades, the coolant liquid removes heat from the blades which cools the polymer solution in contact therewith and causes the polymer to precipitate from the solution in the form of fibrils.

When the polymer solution, precipitated fibrils and coolant liquid come to the discharge port 22, they leave the centrifugal spinning apparatus via opening 24 and are collected for further processing and recovery. Typically, the product will be treated and recovered in the manner as illustrated and discussed in U.S. Pat. No. 4,013,751. Specifically, the product will be passed through a wringer to express the bulk of the liquid from the polymer solids which then will be beaten one or more times in isopropanol to remove the remainder of the solvent and coolant liquid from the fibrils. The fibrils then are filtered and dried for use.

The process of the invention can be employed to prepare fibrils from essentially any polymer solution in which the difference in polymer solubility between the two operating temperatures is sufficiently large. The quality of the fibrils produced, of course, will be importantly influenced by the polymer from which they are prepared.

Fibrils of optimum properties are prepared from olefin polymers having a very high molecular weight such that the polymer has an intrinsic viscosity of at least 3.5. One species of such polymers consists of ethylene polymers containing, on a weight basis, at least 90% of polymerized ethylene. Such ethylene polymers will be ethylene homopolymers or ethylene copolymers containing small quantities of $C_4$ or higher olefin comonomer such as butene, hexene, styrene, a conjugated diene such as butadiene, or the like. A second species of such olefin polymers consists of propylene polymers containing, on a weight basis, at least 50% of polymerized propylene. Such propylene polymers will be propylene homopolymers, or propylene copolymers containing up to 50% of copolymerized ethylene.

In the preparation of the fibrils of this invention, fibrils having a highly satisfactory combination of overall properties are obtained when the polymer employed in the process consists entirely of an olefin polymer as described above. It has been observed, however, that fibrils of generally satisfactory properties can be obtained when a mixture of polymers is employed in the process, provided that the olefin polymer as described above, constitutes at least about 20 weight % and preferably at least 35 weight % of the total polymer employed in the fibril-manufacturing process.

Where polymers other than an olefin polymer, as described above, are employed as a part of the polymer used in the fibril-manufacturing process, the other polymers employed may be employed for either of two principal purposes. For one, such other polymers can be employed principally to lower the raw material cost of the fibrils to be prepared. In some cases, such other polymers can be employed to modify specific properties of the fibrils themselves, or the water-laid, paper-like sheets prepared therefrom. Regardless of the purpose for which such other polymers are employed, for convenience of description, the polymers employed in the fibril-manufacturing process, in addition to the olefin polymers described above, will be referred to as "diluent polymers." Diluent polymers suitable for this purpose are those set forth in U.S. Pat. No. 4,013,751.

The solvent to be employed in the process of the invention may be any liquid which will completely dissolve the olefin polymer employed in the process at an elevated temperature. It is highly desirable that the solvent employed have a significantly different capacity to dissolve the olefin polymer at different temperatures. The ideal solvents are those having a very low solubility for the olefin polymer at ambient temperature, but having a high degree of solvent power for the olefin polymer at temperatures above 140° C. Hydrocarbon solvents such as kerosene, mineral spirits, tetraline and aromatic hydrocarbons such as xylenes, have excellent characteristics for use in the invention and are the preferred solvents to be employed in the invention. Other solvents, however, such as certain of the chlorinated hydrocarbons, also can be employed if desired. The solvents employed should be liquids at ambient temperature and preferably should have atmospheric boiling points above 150° C. and preferably above 180° C.

The polymer solutions employed in the process should be heated to temperatures of at least 100° C. and preferably 150° C. or higher. Polymer concentrations of 2 weight % or higher should be employed.

By reason of the process by which the fibrils of the invention are prepared, it is possible to make many modifications of the fibrils which improve their utility in the manufacture of waterlaid sheets. By way of example, certain inorganic pigments, fillers, and the like can be incorporated into the polymer solution and remain physically encapsulated within the polymer filaments when they are precipitated from the fine polymer streams in the cooling step. Typical of the pigments that can be employed for this purpose include titanium dioxide, silica, calcium carbonate, calcium sulfate, and the like. In another variation of the invention, cellulosic papermaking fibers can be incorporated into the polymer solution and are encapsulated within the monofilaments in the cooling step. Waterlaid sheets prepared from such modified fibrils have enhanced opacity, improved printing characteristics, high water resistance, and the like.

What is claimed is:

1. Apparatus for the manufacture of polymer fibrils from a hot viscous solution of thermoplastic polymer consisting essentially of:

a. a housing having a cylindrical cavity therein, b. an impeller mounted for rotation within said cylindrical cavity, said impeller having a plurality of blades whose narrow dimensions lie substantially in the plane of the impeller's rotation and whose tips come in close proximity to the inner peripheral surface of the cylindrical cavity, said impeller blades having a thickness of less than about one inch, said blades being arranged in at least two substantially-identical sets and in which, within each set, the blades are offset substantially equidistant from one another, both in the rotational plane of the impeller and in the plane transverse therto, c. a discharge port in the bottom of said cylindrical cavity, d. first and second liquid inlet ports in the peripheral surface of the cylindrical cavity, each of said ports being narrow in the plane transverse to the plane of the impeller's rotation and extending over substantially the entire peripheral surface, e. said liquid inlet ports being positioned so that they are near the discharge port of the cylindrical cavity and upstream thereof viewed with respect to the impeller's rotation, so that liquids entering said inlet ports are swept away from the discharge port by rotation of the impeller, f. means for feeding different liquids to the first and second inlet ports, and g. means for rotating the impeller at a speed such that the tip speed of the impeller blades is at least about 200 feet per second.

2. Apparatus of claim 1 in which the narrow dimension of the impeller's blades is less than about one inch, in which the blades are arranged in at least two substantially-identical sets and in which, within each set, the blades are offset substantially equidistant from one another, both in the rotational plane of the impeller and in the plane transverse thereto.

3. Apparatus of claim 2 in which the ratio of the cylindrical cavity's diameter to its depth is at least about 5.0:1.0.

4. Apparatus for the manufacture of polymer fibrils from a hot viscous solution of thermoplastic polymer consisting essentially of:

a. a housing having a cylindrical cavity therein, b. a discharge port in said housing, c. means for feeding two different liquids into said cylindrical cavity, d. an impeller which rotates within said cylindrical cavity at a speed to provide blade tip speeds of at least about 200 ft/sec., e. the blades of said impeller having their narrow dimension in their plane of rotation, and f. the tip of said impeller blades rotating in close proximity to the inner peripheral surface of said cylindrical cavity.

5. Apparatus of claim 4 in which the narrow dimension of the impeller's blades is less than about one inch, in which the blades are arranged in at least two substantially-identical sets and in which, within each set, the blades are offset substantially equidistant from one another, both in the rotational plane of the impeller and in the plane transverse thereto.

* * * * *